US009765414B2

(12) United States Patent
Zou et al.

(10) Patent No.: US 9,765,414 B2
(45) Date of Patent: Sep. 19, 2017

(54) HEAT TREATMENT METHOD OF TURNOUT TRACK AND THE TURNOUT TRACK

(71) Applicants: Pangang Group Panzhihua Iron & Steel Research Institute Co., Ltd., Panzhihua (CN); Pangang Group Panzhihua Steel & Vanadium Co., Ltd., Panzihua (CN)

(72) Inventors: Ming Zou, Panzhihua (CN); Zhenyu Han, Panzhihua (CN); Dongsheng Mei, Panzhihua (CN); Yong Deng, Panzhihua (CN); Hua Guo, Panzhihua (CN); Quan Xu, Panzhihua (CN); Chunjian Wang, Panzhihua (CN)

(73) Assignees: PANGANG GROUP PANZHIHUA IRON & STEEL RESEARCH INSTITUTE CO., LTD., Panzhihua (CN); PANGANG GROUP PANZHIHUA STEEL & VANADIUM CO., LTD., Panzhihua (CN)

( * ) Notice: Subject to any disclaimer, the term of this patent is extended or adjusted under 35 U.S.C. 154(b) by 915 days.

(21) Appl. No.: 14/142,268

(22) Filed: Dec. 27, 2013

(65) Prior Publication Data

US 2014/0182751 A1 Jul. 3, 2014

(30) Foreign Application Priority Data

Dec. 31, 2012 (CN) ..... 2012 1 0590752

(51) Int. Cl.
*C21D 9/04* (2006.01)
*C21D 1/02* (2006.01)
(Continued)

(52) U.S. Cl.
CPC ..... *C21D 9/04* (2013.01); *C21D 1/02* (2013.01); *C21D 1/18* (2013.01); *E01B 7/00* (2013.01)

(58) Field of Classification Search
CPC .... C21D 9/04; C21D 1/18; C21D 1/02; E01B 7/00
See application file for complete search history.

(56) References Cited

U.S. PATENT DOCUMENTS 4,486,248 A * 12/1984 Ackert ..... C21D 9/04 148/581
4,938,460 A * 7/1990 Wechselberger ..... C21D 9/04 266/249
(Continued)

*Primary Examiner* — Veronica F Faison
(74) *Attorney, Agent, or Firm* — Volpe and Koenig, P.C.

(57) ABSTRACT

The present invention provides a heat treatment method of turnout track comprising performing an accelerated cooling on the turnout track to be treated having a railhead tread with a temperature of 650-900° C. so as to obtain the turnout track with full pearlite metallographic structure, wherein the accelerated cooling velocity performed on the working side of railhead of the turnout track is higher than that performed on the non-working side of the railhead of the turnout track. The present invention provides a turnout track obtained with a heat treatment process as depicted therein. The turnout track in present invention has good straightness; both the hardness and tensile strength of the working side of railhead are higher than that of the non-working side of railhead.

20 Claims, 2 Drawing Sheets

(51) Int. Cl.
*C21D 1/18* (2006.01)
*E01B 7/00* (2006.01)

(56) References Cited

U.S. PATENT DOCUMENTS 5,209,792 A * 5/1993 Besch ..... C21D 9/04
148/320
5,714,020 A * 2/1998 Perrin ..... C21D 9/04
148/581
5,762,723 A * 6/1998 Ueda ..... C21D 1/84
148/320
5,830,286 A * 11/1998 Ueda ..... C21D 9/04
148/330
2003/0192625 A1* 10/2003 Cordova ..... C22C 38/42
148/320
2004/0187871 A1* 9/2004 Kimmel ..... A61M 16/0051
128/204.23
2011/0226389 A1* 9/2011 Ueda ..... C21D 9/04
148/330
2011/0253268 A1* 10/2011 Zou ..... C21D 1/667
148/584
2015/0232968 A1* 8/2015 Zou ..... C21D 1/18
148/582

* cited by examiner

HEAT TREATMENT METHOD OF TURNOUT TRACK AND THE TURNOUT TRACK

CROSS REFERENCE TO RELATED APPLICATIONS

This application claims the priority to Chinese Application No. 201210590752.9, filed on Dec. 31, 2012, entitled "A Heat Treatment Method of Turnout Track and the Turnout Track" which are specifically and entirely incorporated by reference.

FIELD OF THE INVENTION

The present invention relates to a heat treatment method of turnout track and the turnout track obtained with a heat treatment method thereof.

BACKGROUND OF THE INVENTION

With the rapid development of railway transportation of People's Republic of China (PRC), the railway transportation mode with characteristics of large capacity, high axle load and high density has been initially formed. Under the increasingly harsh conditions of rail track, the damage problem of steel rails and turnout tracks of railway is increasingly prominent. Turnout tracks are not only important equipment for performing railway connection and crossing, but also one of key links affecting operational efficiency and traffic safety of railways.

At present, turnout tracks are processed with a mode that steel rail manufacturers provide raw materials and the turnout truck manufacturers carry out milling process and subsequent treatments. Generally, the strength and hardness of hot-rolled turnout tracks are relatively low, the turnout tracks are prone to generate harmful defects such as stripping and falling-off, and rapid abrasion, particularly under the impact of impulsive load of heavy haul train. Therefore, the processed turnout tracks are required to conduct heat treatment, so as to improve the overall performance of turnout track and extending its service life. However, due to a mode of processing firstly and heat treatment is then applied, the steel rails are anew experienced with austenization and cooling process, its mechanical parameters (e.g., straightness) are difficult to meet the higher requirements, thereby limiting the applications of turnout tracks in the high-speed and quasi-high-speed rail lines. Meanwhile, the depth of the hardened layer of railhead is limited under an off-line heating condition, the depth is usually less than 15 mm, while the maximum processing depth of turnout split reaches 23 mm, the hardening effect is difficult to be effectively utilized, thereby affect the service life of turnout tracks.

In recent years, the evolution of on-line heat treatment technology for steel rails provides fresh ideas for heat treatment of turnout track as follows: by imposing cooling medium to railhead and other parts of steel rails having residual heat following a hot-rolling process, can obtain the turnout tracks with significantly improved performances as compared with those in a hot-rolled state.

SUMMARY OF THE INVENTION

The object of the present invention is to provide a heat treatment method of turnout track on the basis of prior art, such that the obtained turnout track has good straightness, and both the tensile strength and hardness of the working side of railhead of the turnout track are significantly higher than that of the non-working side of railhead.

The applicant of present application found out in the research process that there still exist considerable technical defects from processing turnout track directly with existing steel rail on-line heat treatment technology, the reasons are as follows: as compared with ordinary steel rail, the turnout track has an asymmetric cross-section, the area of working side of railhead accounts for a high proportion than those of non-working side of railhead. Therefore, if the turnout trucks are applied with steel rail on-line heat treatment technology of the prior art, the working side and non-working side of railhead of turnout track are cooled in an identical accelerated cooling process, in the course of accelerated cooling treatment, on the one hand, the turnout tracks with excellent performances is not available because the working side of railhead have a higher heat capacity and is cooled at a slower rate; on the other hand and more importantly, the side with a higher velocity of cooling (i.e., the non-working side of railhead) will bend toward the side with a lower velocity of cooling (i.e., the working side of railhead) in the process of accelerated cooling, which brings about adverse influences on full length straightness of the turnout tracks and subsequent straightening process; in addition, if the accelerated cooling velocity of working side and non-working side of railhead is enhanced simultaneously, such approach will significantly increase the risk of generating abnormal microscopic structures, and cause the turnout track to be scrapped. To sum up, if the turnout trucks are applied with prior art of steel rail on-line heat treatment technology, such a heat treatment will be difficult to effectively meet production requirements on turnout tracks.

On the basis of above research, the present applicant did a creative job and found that the above-mentioned technical problem can be solved on a condition that different accelerated velocities are imposed on working side and non-working side of railhead of the turnout track respectively, and it is guaranteed that the accelerated cooling velocity of working side of railhead of the turnout track is higher than that of non-working side of railhead of the turnout track, in addition, the temperature of railhead tread to be treated is necessarily ensured to be 650-900° C. in the initial phase of accelerated cooling process. The subtle part of temperature control resides in that if the initial temperature is higher than 900° C., the temperature of surface layer of the turnout track will decrease rapidly as it is chilled by the cooling medium, at the moment, the heat stemmed from the core portion of railhead and waist portion of the rail is promptly diffused to surface layer of the turnout track, and will form a zone with a slowly sliding temperature in a portion which is approximately 5-15 mm underneath the railhead tread. Thus, with the development of the cooling process, the phase change will be initiated with a smaller degree of sub-cooling and successively completed. Since the temperature is slowly declined under such a temperature condition, the performance (e.g., strength and hardness) of the ultimately produced turnout track is relatively low, thus cannot meet use demand of rail lines; on the other hand, if the initial temperature of railhead tread is below 650° C., as the temperature is close to the temperature of phase transformation point, excessive high cooling velocity will significantly increase the risk of generating abnormal metallographic structures (such as bainite and martensite) in the surface layer of steel rail and a certain depth underneath the surface layer, the produced abnormal structures will render the turnout track to be scrapped and cause serious economic losses. The present invention is finalized on the basis of above findings.

In order to fulfill the above objectives, according to a first aspect of present invention, the present invention provides a heat treatment method of turnout track, wherein the method comprises: performing an accelerated cooling on the turnout track to be treated having a railhead tread with a temperature of 650-900° C. so as to obtain the turnout track with full pearlite metallographic structure, wherein the accelerated cooling velocity performed on working side of the railhead of the turnout track is higher than that performed on non-working side of the railhead of the turnout track.

According to a second aspect of present invention, the present invention provides a turnout track obtained by the heat treatment method as recited in present invention, both the hardness and tensile strength of the working side of railhead are higher than that of the non-working side of railhead, for example, in a preferred embodiment of present invention, the hardness of the working side of railhead of turnout track is 1-3 HRC higher than that of the non-working side of railhead, the tensile strength of the working side of railhead of turnout track is 20-50 MPa higher than that of the non-working side of railhead, in addition, the turnout tracks have good straightness, and possess excellent performance of rolling contact fatigue resistance and abrasion resistance during use, are ideal for a mixed transportation of ordinary passenger train and freight train, as well as heavy haul railway withstanding contact fatigue damage and with high severe abrasion.

Other characteristics and advantages of the present invention will be further detailed in the embodiments hereunder.

DESCRIPTION OF FIGURES

Figures are provided for facilitating further understanding of present invention, and constitute a part of the description, and serve to explain present invention together with the embodiments hereunder, it shall not be deemed as constituting any limitation to the present invention. In the following figures.

Figure 1:
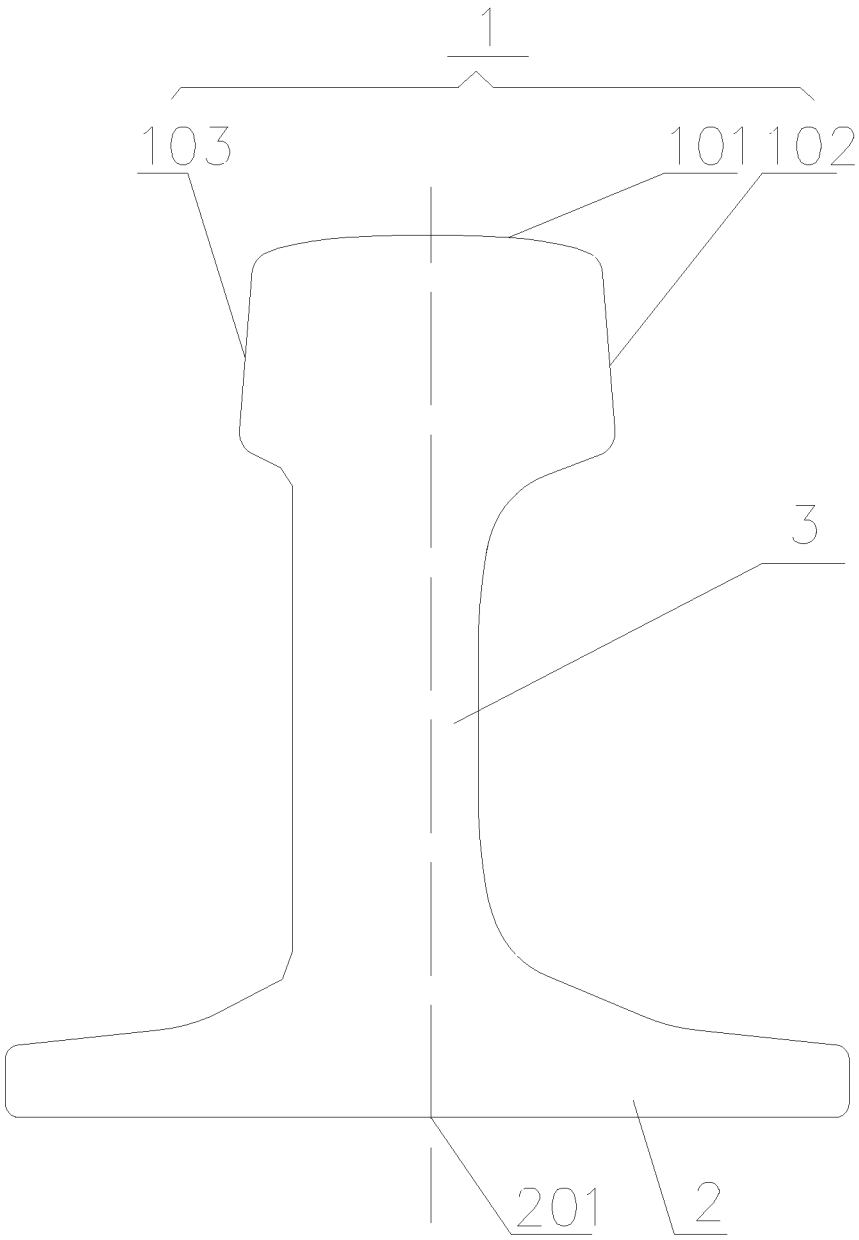
FIG. 1 is a cross-section diagram of a turnout track of the present invention.

Description of Reference Numerals:

| | | | |
|---|---|---|---|
| 1 | railhead | 2 | railbase |
| 101 | railhead tread | 102 | working side of railhead |
| 103 | non-working side of railhead | 201 | center of railbase |
| 3 | rail waist | | |

DETAILED DESCRIPTION OF THE EMBODIMENTS

Hereunder the embodiments of the present invention will be detailed with a combination of figures. It should be appreciated that the embodiments described here are only provided to describe and explain the present invention, but shall not be deemed as constituting any limitation to the present invention.

The present invention provides a heat treatment method of turnout track, wherein the method comprises: performing an accelerated cooling on the turnout track to be treated having a railhead tread with a temperature of 650-900° C. so as to obtain the turnout track with full pearlite metallographic structure, wherein the accelerated cooling velocity performed on working side of railhead of the turnout track is higher than that performed on non-working side of railhead of the turnout track.

As illustrated in FIG. 1, the present invention recites that railhead tread 101 refers to the portion where the top surface of railhead contacts with wheels; working side of railhead 102 refers to the portion of railhead under wheel rolling and shock loading imposed by a moving train after the railhead of turnout track is applied with a milling processed and the product is assembled into a turnout track thereby guide the movement of train; non-working side of railhead 103 refers to the other side of railhead portion which does not contact with wheels of train, wherein the railhead 1 comprises railhead tread 101, working side of railhead 102 and non-working side of railhead 103; railbase 2 refers to the bottom of turnout track; center of railbase 201 refers to the central portion of railbase 2; rail waist 3 refers to a portion connecting the railhead 1 and railbase 2 of the turnout track. The above features are well known among the person skilled in the art, the applicant will not describe them in detail herein.

According to a heat treatment method of turnout track as recited in the present invention, in order to further improve performance of turnout track in the present invention, for example, to refine straightness of turnout track obtained according to a heat treatment method in the present invention, preferably the accelerated cooling velocity performed on the working side of railhead of the turnout track is 0.1-1° C./s higher than that performed on the non-working side of railhead of the turnout track, wherein, in the course of implementing embodiments, in order to obtain a high-performance turnout track with full pearlite metallographic structure within the range of the accelerated cooling velocity difference between working side of railhead of the turnout track and non-working side of the railhead, the specifically selected accelerated cooling velocity difference may be adjusted according to the characteristics of the treated steel and accelerated cooling velocity actually performed on the non-working side of the railhead.

According to a heat treatment method of turnout track as recited in the present invention, as long as the accelerated cooling velocity performed on the working side of the turnout track railhead is higher than that performed on the non-working side of the turnout track railhead, preferably the accelerated cooling velocity performed on the working side of railhead of the turnout track is 0.1-1° C./s higher than that performed on the non-working side of railhead of the turnout track, the objectives of the present invention can be realized, that is, the turnout track obtained by means of a heat treatment method in present invention has good straightness, the hardness of the working side of railhead of the obtained turnout track is higher than that of the non-working side of railhead, the tensile strength of the working side of railhead is higher than that of the non-working side of railhead, thus the obtained turnout tracks are more suitable for practical application. According to a preferred embodiment of the present invention, preferably the accelerated cooling velocity performed on the working side of railhead of the turnout track is within the scope of 1.1-6° C./s, the accelerated cooling velocity performed on the non-working side of railhead of the turnout track is within the scope of 1-5° C./s. Imposing the accelerated cooling process on the working side and the non-working side of railhead of the turnout track, the turnout track obtained according to a heat treatment method as recited in the present invention may possess excellent properties.

In accordance with a heat treatment method as recited in the present invention, it may pertain to conventional choice in the field with respect to accelerated cooling velocity performed on the railhead tread and center of railbase of the turnout track. As recited in the present invention, it is preferable that the accelerated cooling velocity performed on the railhead tread of the turnout track is within the scope of 1-5° C./s, the accelerated cooling velocity performed on the center of railbase of the turnout track is within the scope of 1-5° C./s either.

According to a heat treatment method as recited in the present invention, it is preferable that the accelerated cooling velocity performed on the railhead tread of the turnout track is within the scope of 1-5° C./s, the accelerated cooling velocity performed on the center of railbase of the turnout track is within the scope of 1-5° C./s, and the accelerated cooling velocity performed on the non-working side of railhead of the turnout track is within the scope of 1-5° C./s either, the reasons are as follows:

The inventor of the present invention found in the research process that during a process that the turnout truck is applied with a heat treatment according to a method as recited in the present invention, when the cooling velocity is less than 1° C./s, the temperature of surface layer of the turnout track is significantly decreased in the initial stage of cooling process, the cooling process persist for some time, then the temperature of surface layer is no longer reduced, or even goes up, due to a heat replenishment from its core portion, which cause the effect of accelerated cooling is not obvious; when the cooling velocity is higher than 5° C./s, the cooling velocity of the surface layer and a certain depth underneath the surface layer of railhead of the turnout track is excessively high, the railhead is prone to produce abnormal metallographic structures (e.g., bainite and martensite), thereby increase the risk of brittle failure of the turnout track under the stress of railway wheels moving in a back and forth manner in the service process.

In accordance with a heat treatment method as recited in the present invention, in order to make the turnout track obtained according to a heat treatment method as recited in the present invention with full pearlite metallographic structure, it is preferably when the temperature of railhead tread is lowered to 400-550° C., the accelerated cooling process is ceased, and the turnout track is directly applied with air cooling until the track is cooled to room temperature.

According to a heat treatment method as recited in the present invention, it is preferably when the temperature of railhead tread is lowered to 400-550° C., stopping the accelerated cooling process, and directly cooling the turnout track to room temperature by air cooling, the reasons are as follows:

The inventor of the present invention found in the research process that the central portion of railhead of the turnout track is required to finish its phase transition in a bigger degree of sub-cooling as possible, so as to ensure the central portion can obtain more excellent performance. Generally speaking, it is difficult to monitor the temperature of core portion of railhead with physical means in the practical production processes, the temperature may be obtained through converting the monitored surface temperature of turnout track. The inventor of present invention found in the research process that when the final cooling temperature performed on the railhead tread following the accelerated cooling process is higher than 550° C., the temperature of central portion of the railhead will exceed 600° C., while under such a temperature the steel rail has begun to occur a phase transition or a partial phase transition, i.e., the process of phase transition has not completed. If the accelerated cooling process is stopped at the moment, the heat derived from rail waist portion of the turnout track will swiftly diffuse to the central portion and cause the temperature of the central portion pick up, thereby the cooling rate of phase transition is decreased, the overall performance of the ultimately obtained turnout track are relatively low; when the final cooling temperature of railhead tread following the accelerated cooling process is lower than 400° C., the phase transition of the whole cross-section of railhead and center of railbase has been completed for the time being, continuing to impose forced cooling is no longer with significance, therefore, the final cooling temperature performed on the accelerated cooling process is set in the scope of 400-550° C.

In the present invention, the temperature is measured with an infrared thermometer.

According to the heat treatment method of the present invention, the accelerated cooling performed on the turnout track is generally performed through blowing accelerated cooling medium to the parts need to be treated with an accelerated cooling process, for example, in order to impose accelerated cooling treatment on the railhead tread, working side of railhead, non-working side of railhead and center of railbase, it can be realized by blowing accelerated cooling medium to the railhead tread, working side of railhead, non-working side of railhead and center of railbase respectively and control the accelerated cooling velocity performed on the each part. The above features are well known among the person skilled in the art, the applicant will not describe them in detail herein.

In the present invention, the cooling medium applied for an accelerated cooling process may be a conventional choice in the field, for example, the cooling medium may be water mist mixture or compressed air.

According to the heat treatment method of present invention, the heat treatment method as recited in present invention may be applied to the heat treatment of turnout track comprising various chemical composition of pearlite series. In this regard, no specific requirement is recited in the present invention, and will not be detailed any more here.

In the present invention, the turnout track to be treated having a railhead tread with a temperature of 650-900° C. can be produced according to various method of prior art, for example, the turnout track can be generally produced with following steps:

The molten steel for turnout track is prepared with revolving furnace (converter) or electric furnace, the molten steel is went through refinement in low frequency (LF) furnace and RH (Ruhrstahl-Heraeus) or vacuum degassing (VD), then be continuously casted into steel billets with a certain size of cross-section, the steel billets are transferred to heating furnace so as to be heated, the heating temperature is usually 1,200-1,300° C. and soaking time is 3-8 hours, the heated steel billets are rolled into the turnout track with a desirable cross-section by means of rolling pass or universal mill method, when the rolling process is finished, the usual temperature of surface layer of the turnout track (including railhead tread of turnout track) is about 900-1,000° C., in order to obtain the turnout track to be treated having a railhead tread with a temperature of 650-900° C., the turnout track may be positioned in upright direction on the roller bed or the rack, and allow an air-cooling process by standing in air. The present invention does not impose specific requirement, the applicant will not describe them in detail herein.

The present invention provides a turnout track obtained by the heat treatment method as recited therein, the turnout track is composed of full pearlite metallographic structure, and hardness of the working side of railhead of turnout track is higher than that of the non-working side of railhead, preferably 1-3 HRC higher; and tensile strength of the working side of railhead of turnout track is higher than that of the non-working side of railhead, preferably more than 20 MPa higher, and more preferably 20-50 MPa higher.

According to a preferable embodiment of the present application, the turnout track is processed with a heat treatment method of the present invention, when the turnout track to be treated having a railhead tread with a temperature of 650-900° C. contains carbon (C) 0.7-0.8 wt. %, silicon (Si) 0.3-0.9 wt. %, manganese (Mn) 0.8-1.2 wt. %, phosphorus (P) 0.005-0.015 wt. %, sulphur (s) 0.005-0.015 wt. %, chromium (Cr) and/or vanadium (V) and/or niobium (Nb) 0.03-0.8 wt. %, the working side 102 of railhead of the obtained turnout track possess properties that Rp0.2 is 710-845 MPa, Rm is 1130-1370 MPa, A is 10.5-13.5%, Z is 22-28%; the non-working side 103 of the railhead possess properties that Rp0.2 is 680-830 MPa, Rm is 1100-1340 MPa, A is 11-14%, Z is 22-27%.

In the present invention, Rp0.2 refers to yield strength, Rm refers to tensile strength, A refers to elongation and Z refers to reduction of cross section.

In addition, the turnout tracks in the present invention have good straightness, and possess excellent performance of rolling contact fatigue resistance and abrasion resistance during use, are ideal for a mixed transportation of ordinary passenger train and freight train, as well as heavy haul railway withstanding contact fatigue damage and with high severe abrasion. In the present invention, the turnout tracks generally have good straightness means that they possess good straightness along the whole length direction.

The description will detail the present invention with a combination of examples, but the scope of the present invention is not limited thereto.

EXAMPLES 1 TO 8

Figure 2:
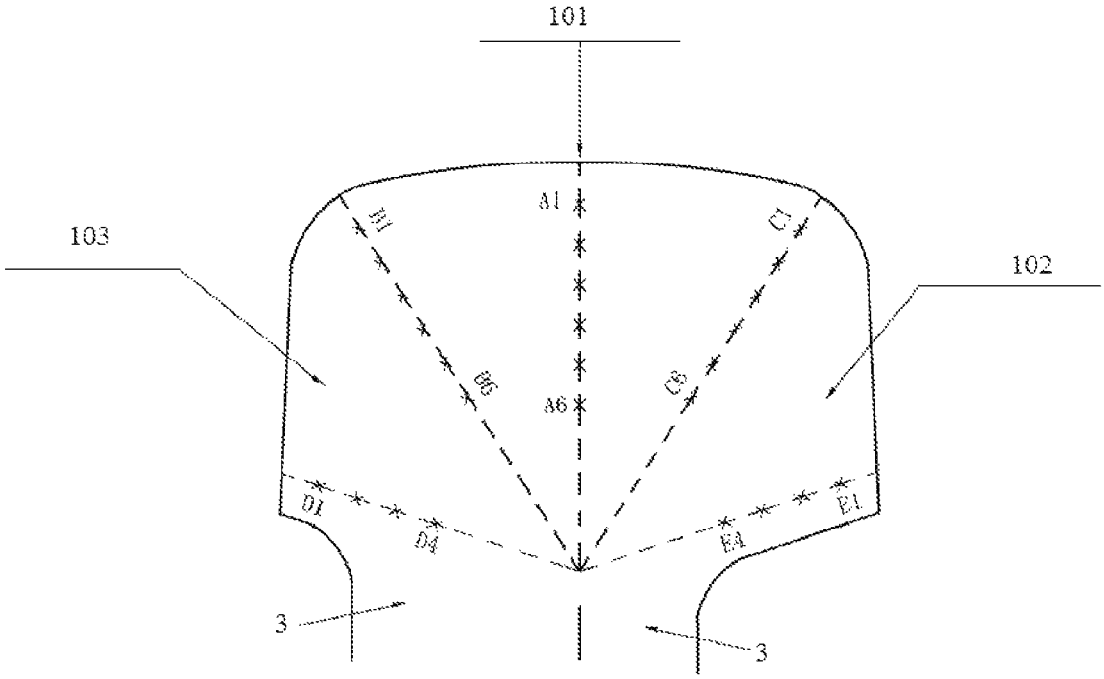
FIG. 2 is a schematic diagram of railhead cross-section hardness test positions of a turnout track of the present invention.

Step (1): the molten steel for turnout track having different chemical compositions is prepared with revolving furnace (converter), the molten steel is refined in a low frequency (LF) furnace and treated with a vacuum degassing process, and then be continuously casted into continuous casting billets with a square cross-section of 280 mm×380 mm, the billets are transferred to heating furnace so as to be heated, the heating temperature is 1,270° C., and the soaking time is 3 hours, thereby obtain steel rails, the steel rails are rolled by means of universal mill into turnout tracks with cross-section of 60 AT, the temperature of railhead tread is 1,270° C., thereby obtain the turnout tracks comprising eight chemical ingredients as illustrated in Table 1;

Step (2): each turnout track is positioned in upright direction on the roller bed, and allows an air-cooling process by standing in air. When the temperature of railhead tread is decreased to a beginning cooling temperature of accelerated cooling as illustrated in Table 2, the turnout track is imposed an accelerated cooling process according to heat treatment method as recited in the present invention (wherein the accelerated cooling velocities performed on the railhead tread, working side of the railhead, non-working side of the railhead and centre of railbase are illustrated in Table 2, and the accelerated cooling velocity is called as cooling velocity in Table 2), when the temperature of railhead tread is decreased to the finishing cooling temperature as illustrated in Table 2, stopping the accelerated cooling process of the turnout tracks, and directly cooling the turnout tracks to room temperature by air cooling, thereby obtain the turnout track. The turnout tracks are underwent a performance testing, Table 4 and 5 set forth some mechanical test results of Examples 1 to 8 (including tensile property, impact property and hardness of railhead cross-section/HRC), wherein hardness of railhead cross-section is obtained in accordance with a measuring method of hardness of railhead cross-section of turnout steel rail in prior art, as illustrated in FIG. 2, the hardness measurement is performed on railhead cross-section of turnout steel rail every once in 5 mm in a direction along the dotted lines. In the present invention, measuring analysis is merely carried out in 10 selected test points, i.e., A1, B1, C1, D1, E1, A6, B6, C6, D4 and E4 as illustrated in FIG. 2, wherein the respective distance between A1, B1, C1, D1, E1 and railhead surface is 5 mm, the respective distance between A6, B6, C6 and railhead surface is 30 mm, the respective distance between D4, E4 and railhead surface is 20 mm, in addition, the tensile property and impact property of working side of railhead are tested.

TABLE 1

| item | number | Chemical composition/wt. % | | | | | |
|---|---|---|---|---|---|---|---|
| | | C | Si | Mn | P | S | Cr + V + Nb |
| Example | 1# | 0.71 | 0.30 | 1.05 | 0.011 | 0.006 | 0.035 |
| | 2# | 0.76 | 0.72 | 0.90 | 0.012 | 0.009 | 0.076 |
| | 3# | 0.75 | 0.55 | 1.05 | 0.010 | 0.011 | 0.283 |
| | 4# | 0.78 | 0.75 | 0.95 | 0.006 | 0.007 | 0.451 |
| | 5# | 0.74 | 0.46 | 0.88 | 0.010 | 0.008 | 0.340 |
| | 6# | 0.77 | 0.82 | 1.12 | 0.013 | 0.010 | 0.192 |
| | 7# | 0.79 | 0.70 | 0.99 | 0.012 | 0.008 | 0.535 |
| | 8# | 0.73 | 0.35 | 1.20 | 0.012 | 0.005 | 0.042 |

TABLE 2

| item | number | beginning cooling temperature of accelerated cooling ° C./s | accelerated cooling velocity performed on the working side of the railhead ° C./s | accelerated cooling velocities performed on the non-working side of the railhead, railhead tread and centre of railbase ° C./s | accelerated cooling velocity difference between working side and non-working side of railhead ° C./s | finishing cooling temperature of accelerated cooling ° C./s |
|---|---|---|---|---|---|---|
| Example | 1# | 812 | 5.0 | 4.0 | 1.0 | 480 |
| | 2# | 895 | 3.3 | 2.6 | 0.7 | 548 |
| | 3# | 703 | 2.3 | 1.8 | 0.5 | 464 |
| | 4# | 665 | 1.1 | 1.0 | 0.1 | 415 |
| | 5# | 695 | 1.9 | 1.5 | 0.4 | 516 |
| | 6# | 710 | 2.0 | 1.2 | 0.8 | 433 |
| | 7# | 726 | 3.5 | 3.1 | 0.4 | 452 |
| | 8# | 652 | 1.8 | 1.6 | 0.2 | 403 |

COMPARATIVE EXAMPLES 1-8

Step (1) : the turnout tracks comprising eight chemical ingredients same as those of Examples 1 to 8 is produced and obtained according to the identical method as illustrated in step (1) of Examples 1 to 8;

Step (2) : the obtained turnout tracks comprising eight chemical ingredients are processed with methods as illustrated in step (2) of Examples 1 to 8; the differences reside in that the accelerated cooling velocities performed on the working side of the railhead, railhead tread, non-working side of the railhead and centre of railbase are applied with an identical accelerated cooling velocity of non-working side of the railhead as illustrated in Table 2, the finishing cooling temperature is controlled to be the same with that of Examples 1-8 (for details, please refer to Table 3), thereby obtain the turnout tracks (Table 4 and Table 5 illustrate a portion of measurement results of mechanical properties of turnout tracks obtained from comparative examples 1-8, including tensile property, impact property and hardness of railhead cross-section/HRC).

TABLE 3

| item | number | beginning cooling temperature of accelerated cooling ° C./s | accelerated cooling velocities performed on the working side of the railhead, non-working side of the railhead, railhead tread and centre of railbase ° C./s | finishing cooling temperature of accelerated cooling ° C./s |
|---|---|---|---|---|
| Comparative Example | 1# | 812 | 4.0 | 480 |
| | 2# | 895 | 2.6 | 548 |
| | 3# | 703 | 1.8 | 464 |
| | 4# | 665 | 1.0 | 415 |
| | 5# | 695 | 1.5 | 516 |
| | 6# | 710 | 1.2 | 433 |
| | 7# | 726 | 3.1 | 452 |
| | 8# | 652 | 1.6 | 403 |

TABLE 4

| | | tensile property | | | | | | | | |
|---|---|---|---|---|---|---|---|---|---|---|
| | | working side of the railhead | | | | non-working side of the railhead | | | | microscopic |
| item | number | Rp0.2/MPa | Rm/MPa | A/% | Z/% | Rp0.2/MPa | Rm/MPa | A/% | Z/% | structures |
| Example | 1# | 710 | 1130 | 13.5 | 26 | 685 | 1100 | 14.0 | 23 | pearlite |
| | 2# | 780 | 1280 | 12.0 | 24 | 770 | 1260 | 11.5 | 24 | pearlite |
| | 3# | 765 | 1260 | 11.5 | 28 | 755 | 1230 | 12.0 | 22 | pearlite |
| | 4# | 845 | 1370 | 10.5 | 22 | 830 | 1340 | 11.0 | 23 | pearlite |
| | 5# | 770 | 1290 | 11.5 | 26 | 750 | 1250 | 11.5 | 26 | pearlite |
| | 6# | 805 | 1300 | 11.5 | 22 | 795 | 1270 | 11.0 | 24 | pearlite |
| | 7# | 825 | 1350 | 11.0 | 23 | 810 | 1330 | 11.0 | 24 | pearlite |
| | 8# | 735 | 1170 | 13.0 | 28 | 720 | 1150 | 12.5 | 27 | pearlite |
| Comparative Example | 1# | 685 | 1100 | 13.0 | 24 | 690 | 1110 | 13.5 | 25 | pearlite |
| | 2# | 750 | 1250 | 11.5 | 24 | 765 | 1260 | 12.0 | 25 | pearlite |
| | 3# | 740 | 1190 | 11.0 | 21 | 745 | 1210 | 11.5 | 22 | pearlite |
| | 4# | 800 | 1320 | 10.5 | 25 | 810 | 1330 | 10.5 | 24 | pearlite |
| | 5# | 740 | 1250 | 11.0 | 26 | 745 | 1260 | 11.5 | 27 | pearlite |
| | 6# | 775 | 1260 | 11.0 | 24 | 790 | 1270 | 11.5 | 24 | pearlite |
| | 7# | 795 | 1300 | 11.0 | 26 | 805 | 1320 | 11.5 | 25 | pearlite |
| | 8# | 705 | 1120 | 11.5 | 27 | 720 | 1140 | 12.0 | 28 | pearlite |

As illustrated in Table 4, the test samples of measuring microscopic structures are obtained from the round corners of working side of the railhead.

TABLE 5

| | | hardness of railhead cross-section/HRC | | | | | | | | | |
|---|---|---|---|---|---|---|---|---|---|---|---|
| | | working side of the railhead | | | | railhead tread | | non-working side of the railhead | | | |
| item | number | C1 | C6 | E1 | E4 | A1 | A6 | B1 | B6 | D1 | D4 |
| Example | 1# | 32.5 | 32.0 | 31.5 | 31.5 | 32.0 | 30.0 | 30.5 | 29.5 | 29.5 | 29.0 |
| | 2# | 37.5 | 36.5 | 37.5 | 36.5 | 36.5 | 35.5 | 36.0 | 35.5 | 36.0 | 35.0 |
| | 3# | 37.5 | 37.0 | 37.5 | 36.5 | 37.0 | 36.0 | 36.0 | 35.5 | 36.0 | 35.0 |
| | 4# | 41.5 | 40.5 | 41.0 | 40.5 | 40.5 | 40.0 | 40.0 | 39.5 | 40.5 | 39.5 |
| | 5# | 38.0 | 37.5 | 38.0 | 37.0 | 37.5 | 36.0 | 36.5 | 36.5 | 37.0 | 35.5 |
| | 6# | 38.5 | 37.5 | 38.5 | 38.0 | 37.5 | 37.0 | 37.0 | 36.5 | 37.0 | 36.0 |

TABLE 5-continued

| | | hardness of railhead cross-section/HRC | | | | | | | | | |
|---|---|---|---|---|---|---|---|---|---|---|---|
| | | working side of the railhead | | | | railhead tread | | non-working side of the railhead | | | |
| item | number | C1 | C6 | E1 | E4 | A1 | A6 | B1 | B6 | D1 | D4 |
| | 7# | 40.5 | 39.5 | 40.5 | 40.0 | 40.0 | 39.0 | 39.5 | 38.5 | 39.5 | 38.0 |
| | 8# | 34.0 | 33.5 | 33.0 | 33.0 | 33.5 | 30.5 | 32.5 | 31.5 | 31.0 | 30.5 |
| Comparative | 1# | 31.0 | 31.0 | 30.5 | 30.0 | 30.5 | 29.5 | 30.5 | 30.0 | 30.0 | 29.5 |
| Example | 2# | 36.0 | 34.5 | 36.0 | 34.5 | 35.0 | 35.5 | 35.5 | 34.5 | 35.5 | 34.5 |
| | 3# | 36.0 | 35.5 | 36.0 | 35.5 | 36.5 | 36.0 | 35.5 | 35.0 | 35.5 | 34.5 |
| | 4# | 40.0 | 39.0 | 39.0 | 38.5 | 39.5 | 39.0 | 39.0 | 38.0 | 39.0 | 38.5 |
| | 5# | 36.0 | 35.5 | 36.5 | 35.0 | 36.5 | 36.5 | 36.0 | 35.5 | 35.5 | 34.5 |
| | 6# | 36.0 | 36.0 | 37.0 | 36.5 | 36.0 | 35.5 | 35.5 | 35.0 | 36.0 | 34.5 |
| | 7# | 36.5 | 35.0 | 37.0 | 38.0 | 39.0 | 37.5 | 37.5 | 36.0 | 37.5 | 36.5 |
| | 8# | 32.5 | 32.5 | 32.0 | 32.0 | 32.5 | 29.5 | 31.0 | 28.5 | 28.0 | 27.5 |

As illustrated in Tables 1 to 5, the turnout track obtained with a heat treatment method as recited in the present invention is the turnout track with full pearlite metallographic structure (without generating abnormal metallographic structures, such as bainite and martensite), and the hardness of working side of the railhead of turnout track is higher than that of non-working side of the railhead, the tensile strength of working side of the railhead is higher than that of non-working side of the railhead, in addition, both the tensile property of turnout track and hardness of railhead cross-section are somewhat higher than that of turnout track obtained with a method of prior art, in particular, hardness value of the part which is 30 mm underneath the railhead (i.e., centre of railbase) is not significantly decreased, which is facilitating the turnout track to maintain excellent operational performance following processes of cutting and milling. In a preferred embodiment of the present invention, hardness of the working side of railhead of turnout track is 1-3 HRC higher than that of the non-working side of railhead, the tensile strength of the working side of railhead of turnout track is 20-50 MPa higher than that of the non-working side of railhead, thereby effectively improving impact abrasion resistance property and fatigue resistance property of heat treated turnout track, in the meanwhile, the turnout tracks have good straightness, toughness and plasticity property of the steel of turnout track is maintained at current level, therefore, the turnout tracks obtained with a heat treatment method of the present invention are ideal for a mixed transportation of ordinary passenger train and freight train, as well as heavy haul railway withstanding contact fatigue damage and with high abrasion caused.

While some preferred embodiments of the present invention are described above, the present invention is not limited to the details in those embodiments. Those skilled in the art can make modifications and variations to the technical scheme of the present invention, without departing from the spirit of the present invention. However, all these modifications and variations shall be deemed as falling into the protected domain of the present invention.

In addition, it should be appreciated that the technical features described in the above embodiments can be combined in any appropriate manner, provided that there is no conflict among the technical features in the combination.

Moreover, the different embodiments of the present invention can be combined freely as required, as long as the combinations don't deviate from the ideal and spirit of the present invention. However, such combinations shall also be deemed as falling into the scope disclosed in the present invention.

What is claimed is:

1. A heat treatment method of turnout track comprising performing an accelerated cooling on the turnout track to be treated having a railhead tread with a temperature of 650-900° C. so as to obtain the turnout track with full pearlite metallographic structure, wherein the accelerated cooling velocity performed on the working side of the railhead of the turnout track is higher than that performed on the non-working side of the railhead of the turnout track.

2. The heat treatment method according to claim 1, wherein the accelerated cooling velocity performed on the working side of railhead of the turnout track is 0.1-1° C./s higher than that performed on the non-working side of railhead of the turnout track.

3. The heat treatment method according to claim 1, wherein the accelerated cooling velocity performed on the working side of railhead of the turnout track is within a scope of 1.1-6° C./s, the accelerated cooling velocity performed on the non-working side of railhead of the turnout track is within a scope of 1-5° C./s.

4. The heat treatment method according to claim 2, wherein the accelerated cooling velocity performed on the working side of railhead of the turnout track is within a scope of 1.1-6° C./s, the accelerated cooling velocity performed on the non-working side of railhead of the turnout track is within a scope of 1-5° C./s.

5. The heat treatment method according to claim 1, wherein the accelerated cooling velocity performed on the railhead tread of the turnout track is within a scope of 1-5° C./s, the accelerated cooling velocity performed on the center of railbase of the turnout track is within a scope of 1-5° C./s.

6. The heat treatment method according to claim 2, wherein the accelerated cooling velocity performed on the railhead tread of the turnout track is within a scope of 1-5° C./s, the accelerated cooling velocity performed on the center of railbase of the turnout track is within a scope of 1-5° C./s.

7. The heat treatment method according to claim 3, wherein the accelerated cooling velocity performed on the railhead tread of the turnout track is within a scope of 1-5° C./s, the accelerated cooling velocity performed on the center of railbase of the turnout track is within a scope of 1-5° C./s.

8. The heat treatment method according to claim 4, wherein the accelerated cooling velocity performed on the railhead tread of the turnout track is within a scope of 1-5° C./s, the accelerated cooling velocity performed on the center of railbase of the turnout track is within a scope of 1-5° C./s.

9. The heat treatment method according to claim 1, wherein when the temperature of railhead tread is lowered to 400-550° C., stopping the accelerated cooling process, and directly cooling the turnout track to room temperature by air cooling.

10. The heat treatment method according to claim 2, wherein when the temperature of railhead tread is lowered to 400-550° C., stopping the accelerated cooling process, and directly cooling the turnout track to room temperature by air cooling.

11. The heat treatment method according to claim 7, wherein when the temperature of railhead tread is lowered to 400-550° C., stopping the accelerated cooling process, and directly cooling the turnout track to room temperature by air cooling.

12. The heat treatment method according to claim 8, wherein when the temperature of railhead tread is lowered to 400-550° C., stopping the accelerated cooling process, and directly cooling the turnout track to room temperature by air cooling.

13. A turnout track obtained by the heat treatment method as recited in claim 1.

14. A turnout track obtained by the heat treatment method as recited in claim 2.

15. A turnout track obtained by the heat treatment method as recited in claim 3.

16. A turnout track obtained by the heat treatment method as recited in claim 4.

17. A turnout track obtained by the heat treatment method as recited in claim 5.

18. A turnout track obtained by the heat treatment method as recited in claim 6.

19. A turnout track obtained by the heat treatment method as recited in claim 9.

20. A turnout track obtained by the heat treatment method as recited in claim 10.

* * * * *